US009366097B2

(12) United States Patent
Hu et al.

(10) Patent No.: US 9,366,097 B2
(45) Date of Patent: Jun. 14, 2016

(54) POWER TONG FOR TURNING PIPE

(71) Applicant: Honghua America, LLC, Houston, TX (US)

(72) Inventors: Guo Qiang George Hu, Calgary (CA); Milan Cerovsek, Calgary (CA); Richie Paez, Calgary (CA)

(73) Assignee: HONGHUA AMERICA, LLC, Houston, TX (US)

( * ) Notice: Subject to any disclaimer, the term of this patent is extended or adjusted under 35 U.S.C. 154(b) by 269 days.

(21) Appl. No.: 14/089,056

(22) Filed: Nov. 25, 2013

(65) Prior Publication Data

US 2015/0143960 A1 May 28, 2015

(51) Int. Cl.
*E21B 19/16* (2006.01)

(52) U.S. Cl.
CPC ..... *E21B 19/164* (2013.01)

(58) Field of Classification Search
CPC ... E21B 19/161; E21B 19/163; E21B 19/164; B25B 13/50; B25B 13/5016; B25B 13/505; B25B 23/145; B25B 23/147; B25B 27/0007; B25B 27/0014
USPC ..... 81/57.15, 57.21, 57.33
See application file for complete search history.

(56) References Cited

U.S. PATENT DOCUMENTS 4,346,629 A * 8/1982 Kinzbach ..... E21B 19/164 81/57.15
4,372,026 A * 2/1983 Mosing ..... E21B 19/164 29/426.5
4,401,000 A * 8/1983 Kinzbach ..... E21B 19/164 81/57.15
4,404,876 A * 9/1983 Eckel ..... E21B 19/164 81/57.18
4,437,363 A * 3/1984 Haynes ..... E21B 19/164 81/57.18
5,167,173 A * 12/1992 Pietras ..... E21B 19/164 81/57.15
6,598,501 B1 * 7/2003 Schulze-Beckinghausen ..... E21B 19/16 81/57.15
6,684,737 B1 * 2/2004 Schulze-Beckinghausen ..... E21B 19/164 81/57.16

(Continued)

*Primary Examiner* — David B Thomas
(74) *Attorney, Agent, or Firm* — Norton Rose Fulbright US LLP

(57) ABSTRACT

A power tong having a self-contained hydraulic power system within its rotating body converts mechanical energy from at least one mechanical link to hydraulic energy within the self-contained hydraulic power system. Energy applied from the non-rotating portion of the power tong is transferred to the mechanical link that links the fixed portion with the rotating portion of the power tong thus removing the need for rotary seals. The mechanical energy transferred to the self-contained hydraulic power system within the rotating body is used to extend and retract one or more grippers in contact with, for example, a tubular of well equipment drill strings.

20 Claims, 4 Drawing Sheets

(56) References Cited

U.S. PATENT DOCUMENTS 6,745,646 B1 * 6/2004 Pietras ..... E21B 19/163 81/57.19
6,814,149 B2 * 11/2004 Liess ..... E21B 19/164 166/380
7,028,585 B2 * 4/2006 Pietras ..... E21B 19/164 81/57.11
7,188,548 B2 * 3/2007 Liess ..... E21B 19/165 81/57.16
7,313,986 B2 * 1/2008 West ..... E21B 19/161 81/57.15
7,387,050 B2 * 6/2008 Slettedal ..... E21B 19/163 81/57.16
7,762,160 B2 * 7/2010 Basler ..... E21B 19/164 81/57.18
7,836,795 B2 * 11/2010 Vatne ..... E21B 19/164 81/57
7,963,196 B2 * 6/2011 Musemeche ..... E21B 19/164 81/57.15
8,037,786 B2 * 10/2011 Vatne ..... E21B 19/165 81/57.16
8,042,432 B2 * 10/2011 Hunter ..... E21B 19/163 81/57.16
8,109,179 B2 * 2/2012 Richardson ..... E21B 19/164 81/16
8,281,691 B2 * 10/2012 Hickman ..... E21B 19/164 81/57.15
8,291,791 B2 * 10/2012 Light ..... E21B 19/164 81/57.16
9,010,219 B2 * 4/2015 Feigel, Jr. ..... E21B 19/164 81/57.15
9,144,894 B2 * 9/2015 Barnett ..... B25B 17/00
2005/0241442 A1 * 11/2005 Neves ..... E21B 19/164 81/57.34
2006/0081091 A1 * 4/2006 Wesch ..... E21B 19/164 81/57.16
2008/0307930 A1 * 12/2008 Veverica ..... E21B 19/164 81/57.34
2010/0218934 A1 * 9/2010 Halse ..... E21B 21/01 166/77.51
2012/0198954 A1 * 8/2012 Musemeche ..... E21B 19/164 74/414
2014/0311732 A1 * 10/2014 Bertelsen ..... E21B 19/164 166/77.51

* cited by examiner

POWER TONG FOR TURNING PIPE

TECHNICAL FIELD

The invention relates to the field of tools related to wells. More particularly, the invention relates to power tongs for making and breaking joints between sections of pipe.

BACKGROUND

Drill strings, used in drilling wells, comprise drilling and well tools attached to sections of drill tubing. As the string is lowered into the well, additional sections of tubulars are added to extend the string's length. These sections of pipe are connected via threaded sections on each end, sometimes referred to as "pin" and "box," representing the male and female portions of the pipe section. The drill string is held in place while the new section of pipe is rotated into connection with the next pipe. Likewise, tubular sections may be removed by rotating the pipe section in reverse.

Connection and disconnection of drill string tubulars is typically accomplished by a mechanical device such as an iron roughneck. A power tong device is used to rotate the section of pipe. A typical power tong will employ low torque, high speed rotation of the pipe up until full connection with the next pipe. Then the tong will shift into a low speed, high torque setting to complete the mating. By the same vein, when removing pipe, power tongs use the high torque setting to break the joint, and then shift into high speed, low torque rotation to unthread the tubular.

Power tongs must sufficiently grip the tubular section before applying torque. Hydraulic gripping systems located within the rotating portion of a power tong require rotary seals to transfer fluid from the fixed portion of the tong to the rotating portion. These rotary seals can sometimes leak and may wear out. It is therefore desirable to provide a power tong without rotary seals.

SUMMARY OF THE INVENTION

A power tong is provided with a self-contained hydraulic power system. Energy applied from the non-rotating portion of the power tong is transferred to a mechanical link that links the fixed portion with the rotating portion of the power tong. The mechanical link transfers its mechanical energy to a hydraulic system affixed to the rotating portion of the power tong. The hydraulic system then extends one or more grippers to grip a tubular inserted in the tong. Multiple mechanical links are contemplated. In one embodiment, one mechanical link provides energy to extend the one or more grippers. A second mechanical link provides the energy to retract the one or more grippers. In another embodiment, one mechanical link provides energy to both extend and retract the one or more grippers. The one mechanical link may be located above or below the rotating portion of the power tong.

According to one embodiment, the power tong provided comprises a fixed body, a rotating body, at least one gripper affixed to the rotating body, a first mechanical link configured to extend the at least one gripper, and a second mechanical link configured to retract the at least one gripper. According to another embodiment, the power tong further comprises at least one hydraulic cylinder affixed to the rotating body and attached to the first mechanical link, wherein the at least one hydraulic cylinder is configured to convert mechanical energy from the first mechanical link to hydraulic energy for the at least one gripper. In yet another embodiment, the power tong further comprises at least one hydraulic cylinder affixed to the fixed body and attached to the first mechanical link, wherein the at least one hydraulic cylinder is configured to convert hydraulic energy to move the first mechanical link.

According to another embodiment, the first mechanical link of the power tong is attached to both the fixed body and the rotating body, and the second mechanical link is attached to both the fixed body and the rotating body. In yet another embodiment, the first mechanical link further comprises bearings between the portion of the first mechanical link attached to the fixed body and the portion of the first mechanical link attached to the rotating body, and the second mechanical link further comprises bearings between the portion of the second mechanical link attached to the fixed body and the portion of the second mechanical link attached to the rotating body.

In another embodiment, the power tong further comprises at least one main gripper cylinder attached to the at least one gripper for extending and/or retracting the at least one gripper. In one embodiment, the power tong further comprises at least one pilot-to-open valve attached to the at least one main gripper cylinder, wherein the at least one pilot-to-open valve is configured to provide one-way hydraulic fluid to the at least one main gripper cylinder. In yet another embodiment, the second mechanical link is configured to convert the at least one pilot-to-open valve to a two-way valve to allow fluid to exit the at least one main gripper cylinder.

In one embodiment, the power tong comprises at least one hydraulic cylinder affixed to the fixed body and attached to the second mechanical link, wherein the at least one hydraulic cylinder is configured to move the second mechanical link. In another embodiment, at least one electric motor configured to rotate the rotating body of the power tong. In one embodiment, the first mechanical link is disposed above the rotating body, and the second mechanical link is disposed below the rotating body.

In yet another embodiment, at least the fixed body, the rotating body, the first mechanical link, and the second mechanical link are configured to be split into two halves. Likewise, other components may be split in the power tong, such as a bull gear and bearings. This allows for removal of the power tong from the rig floor in emergency situations, for example, without impacting the drilling string. Where hydraulic lines are concerned, quick disconnects are used to facilitate the split of the power tong.

In one embodiment, the power tong comprises, a fixed body, a rotating body, at least one gripper affixed to the rotating body, a first mechanical link configured to extend the at least one gripper, wherein the first mechanical link is attached to both the fixed body and the rotating body, and a second mechanical link is configured to retract the at least one gripper, wherein the second mechanical link is attached to both the fixed body and the rotating body. In another embodiment, the power tong further comprises at least one hydraulic cylinder affixed to the rotating body and attached to the first mechanical link, wherein the at least one hydraulic cylinder is configured to convert mechanical energy from the first mechanical link to hydraulic energy for the at least one gripper.

In one embodiment, the power tong further comprises at least one hydraulic cylinder affixed to the fixed body and attached to the first mechanical link, wherein the at least one hydraulic cylinder is configured to move the first mechanical link. In another embodiment, a self-contained hydraulic system is affixed to the rotating body, configured to accept mechanical energy from the first mechanical link. In another, a self-contained hydraulic system is affixed to the rotating body, configured to accept mechanical energy from the second mechanical link. In another embodiment, a self-contained hydraulic system is affixed to the fixed body, configured to impart mechanical energy to the first mechanical link. In yet another embodiment, a self-contained hydraulic system is affixed to the fixed body, configured to impart mechanical energy to the second mechanical link.

The foregoing has outlined rather broadly the features and technical advantages of the present disclosure in order that the detailed description of the disclosure that follows may be better understood. Additional features and advantages of the disclosure will be described hereinafter which form the subject of the claims of the disclosure. It should be appreciated by those skilled in the art that the conception and specific embodiment disclosed may be readily utilized as a basis for modifying or designing other structures for carrying out the same purposes of the present disclosure. It should also be realized by those skilled in the art that such equivalent constructions do not depart from the spirit and scope of the disclosure as set forth in the appended claims. The novel features which are believed to be characteristic of the disclosure, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present disclosure.

BRIEF SUMMARY OF THE DRAWINGS

For a more complete understanding of the disclosed system and methods, reference is now made to the following descriptions taken in conjunction with the accompanying drawings.

DETAILED DESCRIPTION

Figure 1:
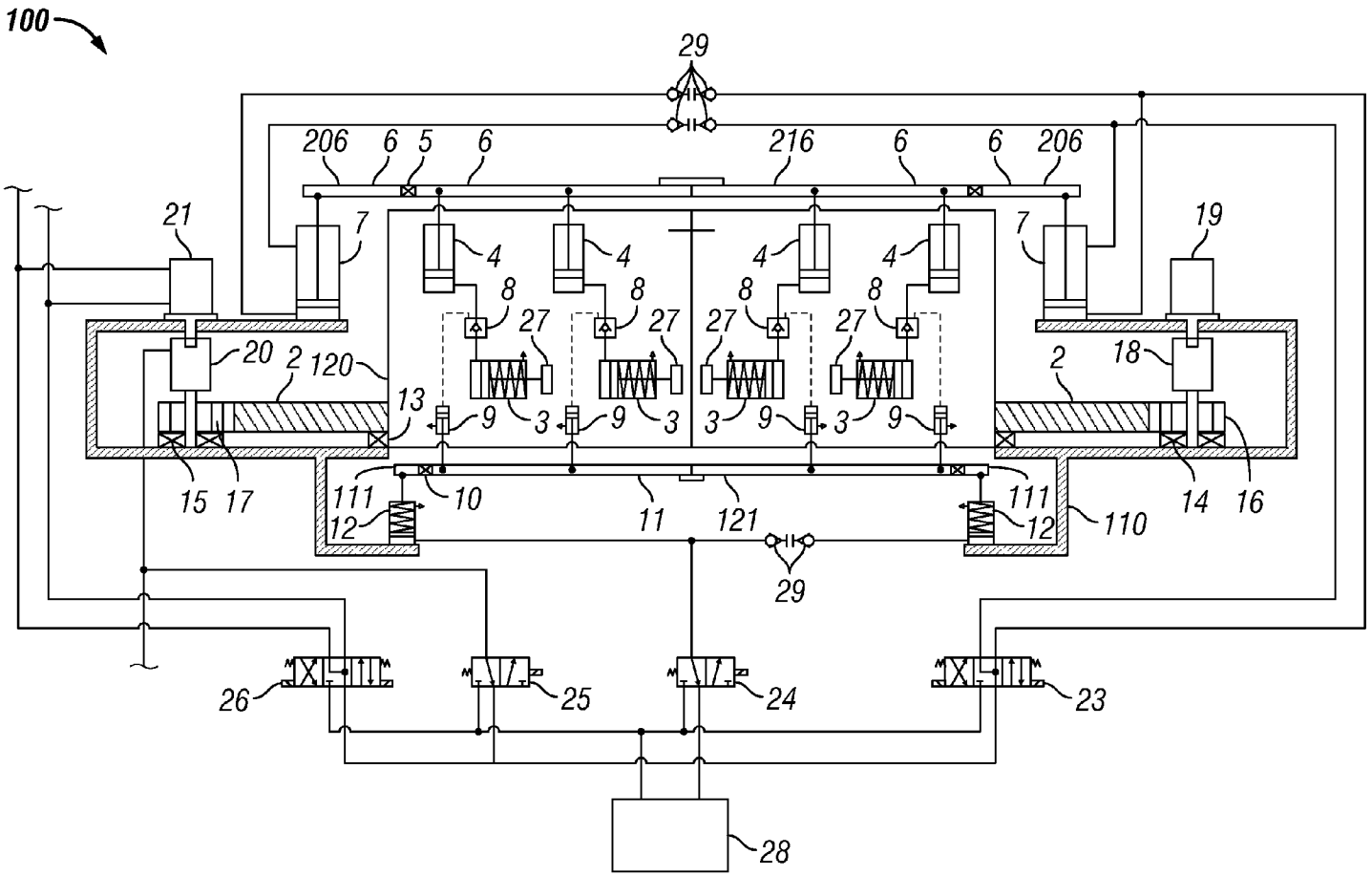
FIG. 1 is a diagram of an embodiment of a power tong according to the present invention.

There is provided a power tong apparatus for use in well equipment. According to one embodiment, FIG. 1 illustrates a power tong assembly 100 having a main body 110 and a rotating body 120. FIG. 1 shows the rotating body 120 in a schematic view. One or more electric motors 19 provide torque through planetary gear box 18 to pinion 16. Pinion 16 can rest on bearings 14. Pinion 16 interacts with bull gear 2 to rotate rotating body 120. In this embodiment, bull gear 2 also accepts torque from hydraulic actuator 21 through hydraulic actuated clutch 20 and pinion 17, which may rest on bearing 15. In this embodiment, electric motors 19 are employed for low torque, high speed rotation of a tubular section in the power tong. Hydraulic actuators 21 are used for high torque, low speed rotation of the tubular. In an alternative embodiment, higher powered electric motors may be used to provide high torque capability to break the joint of well tubulars. Likewise, geared hydraulic actuators may be used to provide higher speed rotation of the tubular after the joint is broken.

Figure 2:
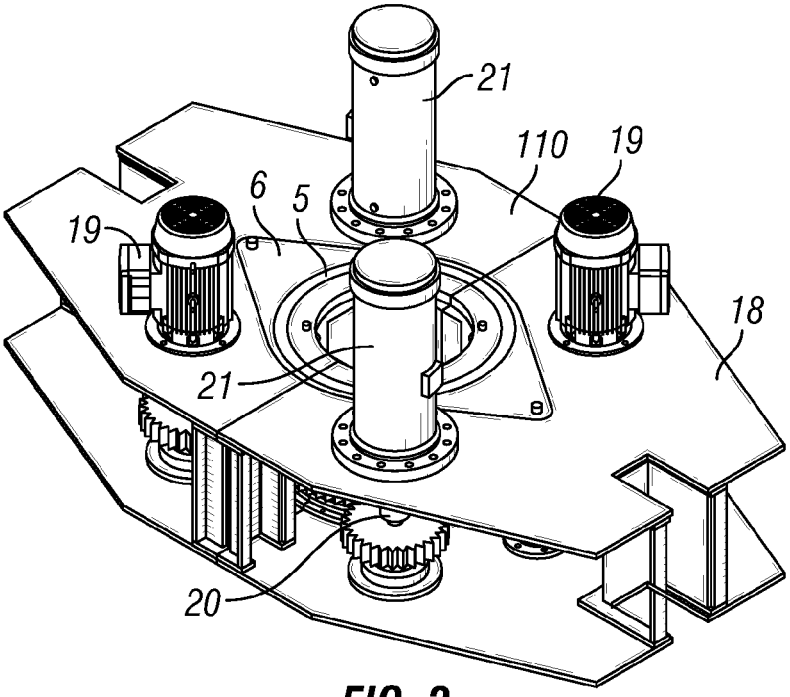
FIG. 2 is an orthogonal diagram of an embodiment of a power tong according to the present invention.

Bull gear 2, according to the embodiment shown in FIG. 1, rests on bearing 13. Where multiple electric motors 19 and multiple hydraulic actuators 21 are employed, multiple pinions interact with bull gear 2 at different locations along the perimeter of bull gear 2. For example, FIG. 2 shows an embodiment having two electric motors 19 and two hydraulic actuators 21. Planetary gear boxes 18 and hydraulic actuated clutches 20 are then used to engage or disengage the respective electric motors 19 and hydraulic actuators 21 from bull gear 2.

Power tong 100, according to the embodiment depicted in FIG. 1, includes a number of hydraulic systems. Hydraulic power unit 28 supplies hydraulic power to hydraulic actuators 21 through directional control valve 26. For redundancy purposes, multiple actuators are contemplated, along with multiple redundant hydraulic power inputs. In FIG. 1, hydraulic power unit 28 also supplies hydraulic power to hydraulic actuated clutches 20 through directional control valve 25. One skilled in the art of hydraulics would understand that alternative designs are possible, for example, with multiple hydraulic power units, and different sorts of control valves.

One of the issues with power tongs employing rotating bodies is providing sufficient hydraulic power to grip the tubular. The transfer of hydraulic energy to the hydraulic system located within the rotating body, in the prior art, requires cumbersome rotary seals. Rotating body 120, according to the embodiment of the present disclosure shown in FIG. 1, has a self-contained hydraulic system that accepts mechanical energy imparted from the non-rotating portion of power tong 100. Upper mechanical link 6 resides above rotating body 120 and comprises two parts, an outer part 206 and an inner part 216. Outer part 206 of upper mechanical link 6 is fixed in place and attached to the fixed body through outside gripper cylinders 7. Inner part 216 of upper mechanical link 6 rotates along with rotating body 120. Upper mechanical link bearing 5 separates outer part 206 and inner part 216, allowing inner part 216 to rotate while still being mechanically attached to outer part 206. In alternative embodiments, multiple bearding rings may be used within upper mechanical link 6.

Figure 5:
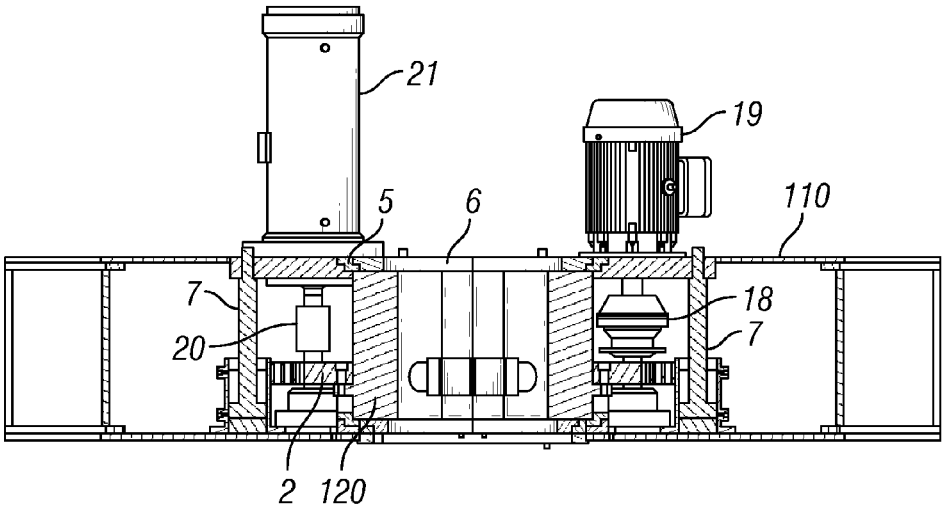
FIG. 5 represents a cross section view of FIG. 4 along the axis indicated.

Outside gripper cylinders 7 reside in the fixed body 110 portion of power tong 100. According to the embodiment shown in FIG. 1, outside gripper cylinders 7 are powered by hydraulic power unit 28 through directional control valve 23. Directional control valves, known in the art, allow fluid flow into different paths from one or more sources. One skilled in the art would understand that many types of valves may be used to divert hydraulic power to the one or more cylinders contemplated in the present disclosure. Outside gripper cylinders 7 are attached to the outside part 206 of upper mechanical link 6. When hydraulic power is applied to outside gripper cylinders 7, the cylinders 7 retract, actuating the upper mechanical link 6 downward, towards rotating body 120. The hydraulic energy of outside gripper cylinders 7 is thus transferred into mechanical energy within upper mechanical link 6. Inner part 216 of upper mechanical link 6 is attached to gripper supply cylinders 4. According to the embodiment shown, gripper supply cylinders 4 reside within rotating body 120 and are attached to inner part 216 of upper mechanical link 6. As upper mechanical link 6 moves downward, mechanical energy is transferred back into hydraulic energy within gripper supply cylinders 4. FIG. 5 depicts a cross-sectional view of outside gripper cylinders 7 according to one embodiment of the present disclosure, showing outside gripper cylinders in the retracted position.

It is understood that many types of hydraulic cylinders may be used for the hydraulic systems of the present disclosure, such as a piston cylinder, plunger cylinder, differential cylinder, telescopic cylinder, and position-sensing cylinder. One skilled in the art would understand that alternative cylinder designs may be selected according to strength, cost, size, weight, force, ability to exert force in two directions, and other design parameters.

Within rotating body 120, grippers 27 make connection between rotating body 120 and the tubular, allowing power tong 100 to transfer torque to the tubular. In the embodiment shown in FIG. 1, gripper supply cylinders 4 supply hydraulic power to main gripper cylinders 3, which extend grippers 27 to make contact with the tubular. Hydraulic fluid is transferred from gripper supply cylinder through pilot-to-open (POC) valves 8 to main gripper cylinders 3. The POC valves 8 contemplated within the embodiment disclosed in FIG. 1 ensure that gripper 27 contact will not be interrupted in the event hydraulic power is lost at any point in the hydraulic systems other than the main gripper cylinders. This fail safe protects the tong from losing grip of the tubular while the power tong is under rotation. POC valves 8 include three ports, with the first and second ports connecting the gripper supply cylinders 4 and main gripper cylinders 3 across the valve portion of POC valves 8. The valve portion is a one-way valve, restricting flow from main gripper cylinders 3 to gripper supply cylinders 4 under normal conditions. POC valves 8 include a third port fluidly connected to the valve portion. When the third port is pressurized, the valve portion shifts, allowing fluid to flow back into gripper supply cylinders 4. Fail safe measures, such as POC valve 8 are contemplated to improve the quality of the disclosed embodiment, but one skilled in the art would understand that other designs are available, with other safety measures or even the lack of safety measures. The POC valves 8 contemplated in FIG. 1 represent one embodiment according to the present disclosure, though equivalent valves are known to those of skill in the art.

Figure 4:
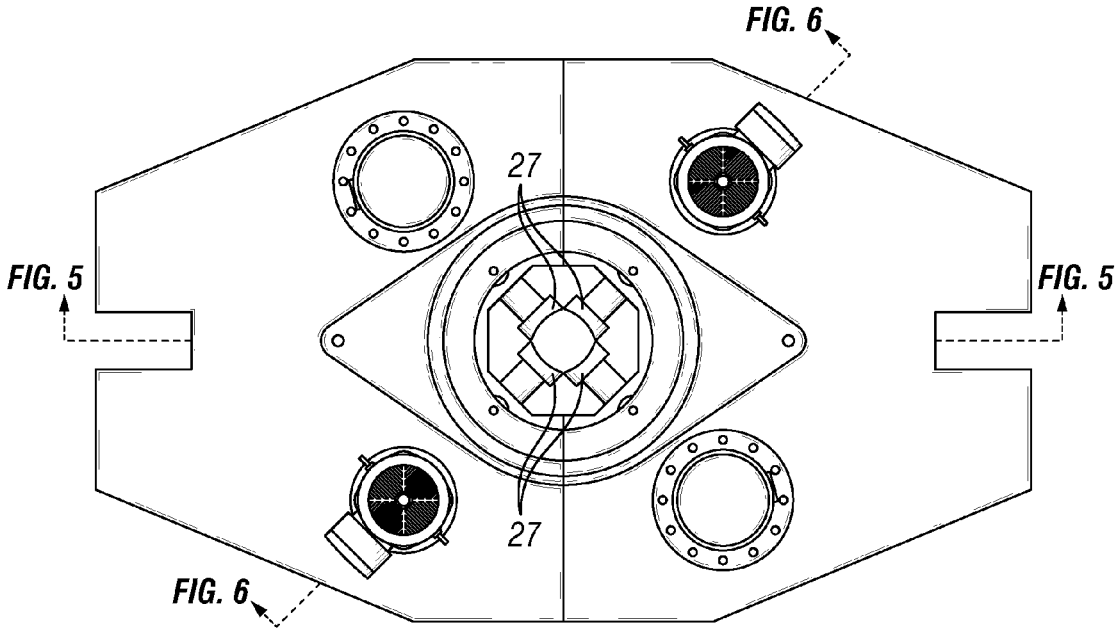
FIG. 4 is a top view of an embodiment of a power tong according to the present invention.
Figure 6:
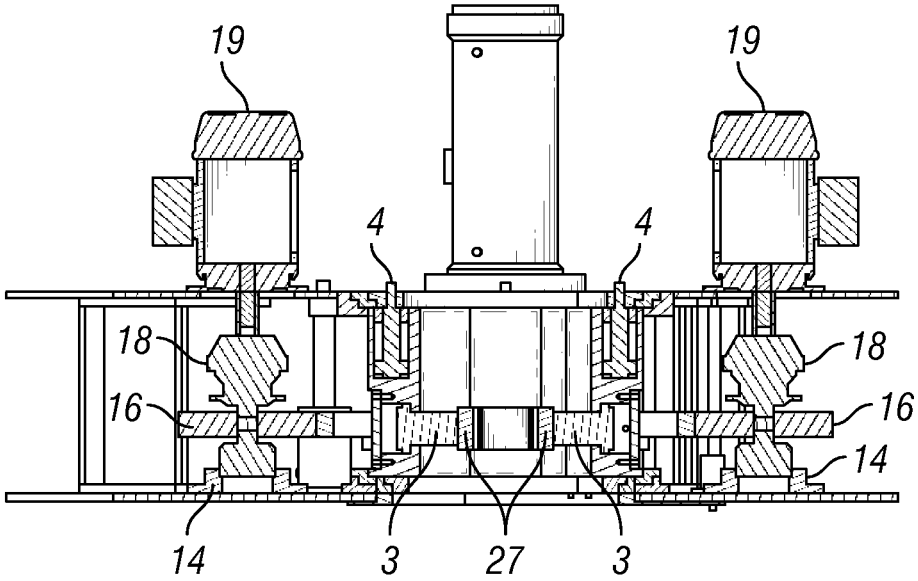
FIG. 6 represents a cross section view of FIG. 4 along the axis indicated.

According to the embodiment in FIG. 1, hydraulic energy is applied from hydraulic power unit 28 to outside gripper cylinders 7, thereby retracting upper mechanical link 6 toward rotating body 120. Upper mechanical link 6 imparts mechanical energy into gripper supply cylinders 4, which transfer hydraulic energy to main gripper cylinders 3 to extend grippers 27 so that they make contact with the tubular. Power tong 100 may then apply torque to the tubular. FIG. 4 depicts a top view according to one embodiment of the present disclosure, where grippers 27 are in the extended position. FIG. 6 likewise depicts a cross-sectional view of FIG. 4 along the line indicated. FIG. 6 shows grippers 27 extended by main gripper cylinders 3.

It should be understood that the disclosed embodiment of FIG. 1 is merely representative. For example, it is provided that that the mechanical link may be positioned underneath the rotating body in an alternative embodiment. In addition, changes in the number and types of actuators, valves, grippers, and cylinders may be made without departing from the spirit and scope of the disclosure. Likewise, a person skilled in the art would recognize alternative designs of the hydraulic system within the rotating body, such as connection of the mechanical link directly to main gripper cylinders 3.

To retract grippers 27, according to the embodiment shown in FIG. 1, a second mechanical link is used. Lower mechanical link 11 resides under rotating body 120. Like upper mechanical link 6, lower mechanical link 11 has a fixed outer part 111, and a rotating inner part 121. These two parts are separated by lower mechanical link bearing 10, which allows inner part 121 to freely rotate while still being mechanically attached to outer part 111. Fixed outer part 111 is attached to outside pilot supply cylinders 12. Outside pilot supply cylinders 12 are supplied hydraulic power through directional control valve 24 from hydraulic power unit 28. Hydraulic fluid flow into outside pilot supply cylinders 12 forces lower mechanical link 11 upward, toward rotating body 120. The upward movement of lower mechanical link 11 depresses POC valve cylinders 9, which in turn pressurize the third port of POC valves 8. POC valves 8, as contemplated in one embodiment, include three ports. With the third port unpressurized, POC valves 8 operate as a one-way valve, allowing hydraulic fluid to travel from gripper supply cylinders 4 to main gripper cylinders 3, but not the reverse. When the third port is pressurized, the one-way valve of POC valves 8 is converted into a two-way valve. According to one embodiment, main gripper cylinders 3 include a compression spring that is used to return gripper 27 to the open position. When POC valves 8 are pressurized and converted to a two-way valve, hydraulic fluid can flow back into the gripper supply cylinders 4. Compression springs in main gripper cylinders 3 push the hydraulic fluid back into gripper supply cylinders 4 and return grippers 27 to the open position.

At the same time the third port on POC valves 8 is pressurized to allow grippers 27 to relax into the open position, directional control valve 23 directs hydraulic power to reverse outside gripper cylinders 7. Upper mechanical link 6 thus moves upward, away from rotational body 120, thereby allowing hydraulic fluid to return from main gripper cylinders 3 through POC valves 8 to gripper supply cylinders 4. According to one embodiment, the negative pressure from gripper supply cylinders 4 pulls hydraulic fluid from main gripper cylinders 3, thus lessening or even removing the need for compression return springs within main gripper cylinders 9.

According to the embodiment shown in FIG. 1, outside pilot supply cylinders 12 contain compression return springs. When the operator removes hydraulic power via directional control valve 24, compression return springs retract outside pilot supply cylinders 12 and thus remove hydraulic fluid from cylinders 12, shifting lower mechanical link 11 downward, away from rotating body 120, and in turn depressurizing POC valves 8. The system is now reset and ready to accept energy to apply grippers 27 to a tubular.

Figure 3:
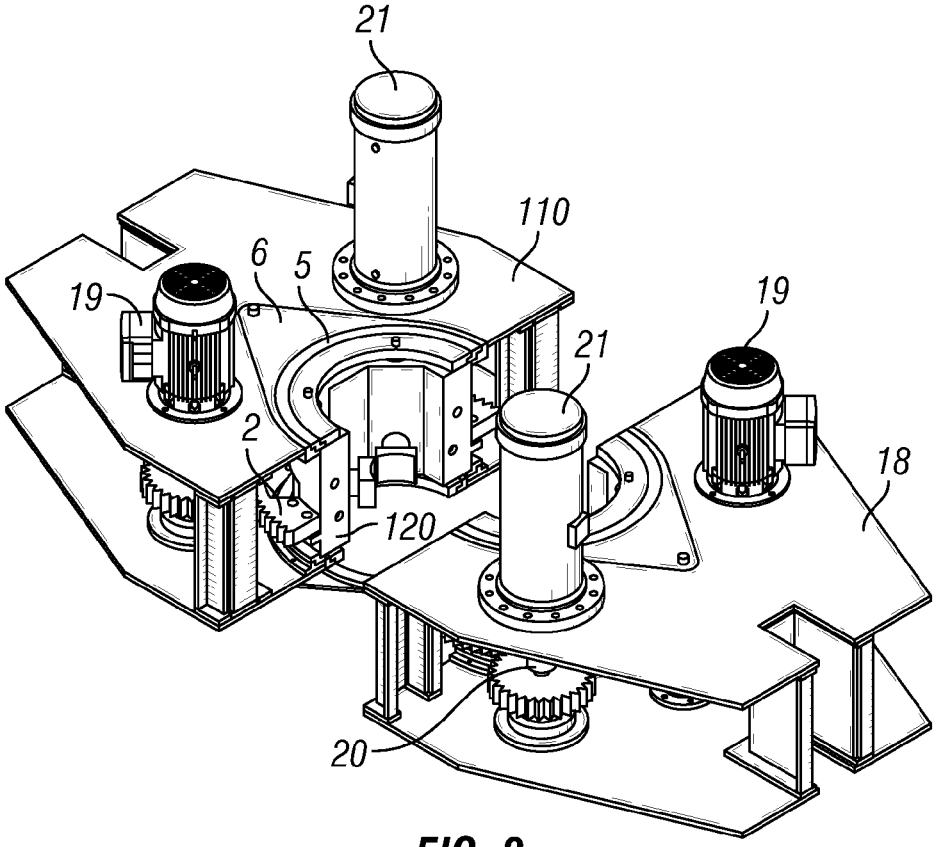
FIG. 3 is an orthogonal diagram of an embodiment of a power tong depicting a split according to the present invention.

According to one embodiment depicted in FIG. 3, power tong 100 may be split in two, such as in an emergency situation. All of the main parts, including the main body 110, rotating body 120, bull gear 2, all bearings 5, 10, 13, both mechanical links 6, 11 may be split. Quick disconnects 29 are provided in the hydraulic fluid lines.

Although the embodiment disclosed in FIG. 1 has been described in detail, it should be understood that changes, substitutions, and alterations may be made without departing from the spirit and scope of the disclosure. For example, additional or fewer gripper assemblies are contemplated, with as few as one active gripper 27 in power tong 100. In addition, it is contemplated that, in an alternative embodiment, one mechanical link may provide mechanical energy to both extend and retract grippers 27 within rotating body 120.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the present invention, disclosure, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A power tong, comprising:

a fixed body;

a rotating body;

at least one gripper affixed to the rotating body;

a first mechanical link configured to extend the at least one gripper;

a second mechanical link configured to retract the at least one gripper;

wherein the first mechanical link is disposed on one side of the rotating body, and the second mechanical link is disposed on the other side of the rotating body.

2. The power tong of claim 1, further comprising:

at least one hydraulic cylinder affixed to the rotating body and attached to the first mechanical link, wherein the at least one hydraulic cylinder is configured to convert mechanical energy from the first mechanical link to hydraulic energy for the at least one gripper.

3. The power tong of claim 1, further comprising:

at least one hydraulic cylinder affixed to the fixed body and attached to the first mechanical link, wherein the at least one hydraulic cylinder is configured to convert hydraulic energy to move the first mechanical link.

4. The power tong of claim 1, further comprising:

at least one main gripper cylinder attached to the at least one gripper for extending and/or retracting the at least one gripper.

5. The power tong of claim 4, further comprising:

at least one pilot-to-open valve attached to the at least one main gripper cylinder, wherein the at least one pilot-to-open valve is configured to provide one-way hydraulic fluid to the at least one main gripper cylinder.

6. The power tong of claim 5, wherein the second mechanical link is configured to convert the at least one pilot-to-open valve to a two-way valve to allow fluid to exit the at least one main gripper cylinder.

7. The power tong of claim 1, further comprising:

at least one hydraulic cylinder affixed to the fixed body and attached to the second mechanical link, wherein the at least one hydraulic cylinder is configured to move the second mechanical link.

8. The power tong of claim 1, further comprising:

at least one electric or hydraulic motor configured to rotate the rotating body.

9. The power tong of claim 1, further comprising:

at least one hydraulic actuator configured to rotate the rotating body.

10. A power tong, comprising:

a fixed body;

a rotating body;

at least one gripper affixed to the rotating body;

a first mechanical link configured to extend the at least one gripper;

a second mechanical link configured to retract the at least one gripper;

wherein the fixed body, the rotating body, the first mechanical link, and the second mechanical link are configured to be split into two halves.

11. A power tong, comprising:

a fixed body;

a rotating body;

at least one gripper affixed to the rotating body;

a first mechanical link configured to extend the at least one gripper, wherein the first mechanical link is attached to both the fixed body and the rotating body; and a second mechanical link configured to retract the at least one gripper, wherein the second mechanical link is attached to both the fixed body and the rotating body.

12. The power tong of claim 11, wherein the first mechanical link further comprises bearings between the portion of the first mechanical link attached to the fixed body and the portion of the first mechanical link attached to the rotating body; and wherein the second mechanical link further comprises bearings between the portion of the second mechanical link attached to the fixed body and the portion of the second mechanical link attached to the rotating body.

13. The power tong of claim 11, further comprising:

at least one hydraulic cylinder affixed to the rotating body and attached to the first mechanical link, wherein the at least one hydraulic cylinder is configured to convert mechanical energy from the first mechanical link to hydraulic energy for the at least one gripper.

14. The power tong of claim 13, further comprising:

at least one hydraulic cylinder affixed to the fixed body and attached to the first mechanical link, wherein the at least one hydraulic cylinder is configured to move the first mechanical link.

15. The power tong of claim 11, further comprising:

a self-contained hydraulic system affixed to the rotating body, configured to accept mechanical energy from the first mechanical link.

16. The power tong of claim 11, further comprising:

a self-contained hydraulic system affixed to the rotating body, configured to accept mechanical energy from the second mechanical link.

17. The power tong of claim 11, further comprising:

a self-contained hydraulic system affixed to the fixed body, configured to impart mechanical energy to the first mechanical link.

18. The power tong of claim 11, further comprising:

a self-contained hydraulic system affixed to the fixed body, configured to impart mechanical energy to the second mechanical link.

19. The power tong of claim 11, further comprising:

at least one electric or hydraulic motor configured to rotate the rotating body.

20. The power tong of claim 11, further comprising:

at least one hydraulic actuator configured to rotate the rotating body.

* * * * *